US006591950B1

(12) United States Patent
Scicluna

(10) Patent No.: US 6,591,950 B1
(45) Date of Patent: Jul. 15, 2003

(54) MULTIPLE EXPANSION LUGGAGE ITEM

(75) Inventor: Paul Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 10/115,402

(22) Filed: Apr. 3, 2002

(51) Int. Cl.[7] ..... A45C 7/00; A45C 13/04; A45C 5/12; A45C 13/30

(52) U.S. Cl. ..... 190/103; 190/36; 190/109; 206/279; 206/287; 206/291

(58) Field of Search ..... 190/36, 103, 109, 190/903, 104, 105; 206/279, 287.1, 290, 291, 292; 211/124

(56) References Cited

U.S. PATENT DOCUMENTS

| | | | | | |
|---|---|---|---|---|---|
| 1,617,365 | A | * | 2/1927 | Batts | 211/124 X |
| 1,706,683 | A | * | 3/1929 | Victorsohn | 211/124 X |
| 1,752,772 | A | * | 4/1930 | Balin | 190/109 X |
| 2,288,867 | A | * | 7/1942 | Meyer et al. | 211/124 X |
| 4,736,854 | A | * | 4/1988 | King et al. | 211/124 X |
| 4,773,515 | A | * | 9/1988 | Kotkins, Jr. | 190/903 X |
| 4,854,602 | A | * | 8/1989 | Takeuchi | 190/122 X |
| 4,925,021 | A | * | 5/1990 | Pulichino, Jr. | 190/903 X |
| 5,505,297 | A | * | 4/1996 | Myers | 190/36 X |
| 5,575,391 | A | * | 11/1996 | Gerch | 190/115 X |
| 5,628,398 | A | * | 5/1997 | Jackson | 190/109 X |
| 6,059,078 | A | | 5/2000 | Nykoluk | 190/103 |
| 6,220,411 | B1 | | 4/2001 | Scicluna et al. | 190/103 |

FOREIGN PATENT DOCUMENTS

| | | | | |
|---|---|---|---|---|
| FR | 1474951 | * | 3/1967 | 190/103 |

* cited by examiner

*Primary Examiner*—Sue A. Weaver
(74) *Attorney, Agent, or Firm*—Baker Botts LLP

(57) ABSTRACT

An item of expandable luggage includes a multiple expansion capability, including an expandable main compartment and an expandable external pocket. The luggage item also includes a pair of internal tie-down panels for better holding of clothes within the item and for providing additional storage pockets. A low-profile clothes hanger bracket is provided which is useful with either wire or wooden clothes hangers.

29 Claims, 2 Drawing Sheets

MULTIPLE EXPANSION LUGGAGE ITEM

BACKGROUND OF INVENTION

1. Field of the Invention

The present invention relates to luggage, especially travel luggage, and in particular to luggage having a multiple expansion capability to provide, when desired, additional storage space.

2. The Related Art

In the commonly owned U.S. Pat. No. 6,220,411 B1, there is disclosed an item of expandable luggage of the "hard" type that includes an expandable main compartment enclosed within two frame components that move apart when the luggage item is expanded. A highly effective bridge assembly couples the frame components together for linear displacement of the two components towards and away from each other, while providing both easy conversion between the retracted and expanded states and high rigidity to the luggage item in the expanded state. The entire subject matter of U.S. Pat. No. 6,220,411 B1 is hereby incorporated by reference for all purposes.

Although the luggage item of U.S. Pat. No. 6,220,411 B1 affords significant advantages over earlier luggage items having variable volumes, there is a need for still further improvements in the provision of expandable-type luggage items.

BRIEF SUMMARY OF THE INVENTION

An object of the present invention is to provide an item of expandable luggage of the "hard" type that has a multiple expansion capability. It is, in particular, an object of the invention to provide double expandability, in accordance with which both the main compartment and a front compartment or pocket are expandable to adjust the size and function of the luggage item to fit a variety of itineraries.

The foregoing objects are attained, in accordance with the present invention, by an item of expandable luggage that includes a frame having a first substantially rigid component and a second substantially rigid component, each of which includes a pair of opposite rectangular wall panels and which together with a pair of opposite wall members form the peripheral boundary of a variable volume main compartment and a rectangular area. A peripherally continuous gusset of flexible material is connected between the wall panels and the wall members of the two frame components and provides, when the luggage item is expanded, a portion of the peripheral wall of the main compartment. To that end, adjacent ends of the first and second frame components carry the mating halves of a peripherally continuous zipper which, when undone, permits the gusset to unfold in the forward direction.

The open front end of the second frame component is covered by a flexible front panel which is connected thereto along at least three sides by a zipper for permitting access to the interior of the main compartment. At least one external pocket is carried by the front panel and, in accordance with the invention, includes along at least three sides thereof a second gusset of flexible material. The edges of the front pocket adjoining the second gusset carry the mating halves of a second zipper which, when undone, permits the second gusset to unfold in the forward direction to enlarge the front pocket volume.

In a preferred configuration, the second gusset and the second zipper extend along the entire bottom and substantially the full length of both sides of the front pocket.

One or more support legs may be mounted on the bottom peripheral wall member of the second frame component. The legs move forward with the second frame component to provide greater stability of the luggage against tipping in the expanded state.

Advantageously, a pair of internal tie-down panels is coupled to respective ones of the interior sides of the pair of opposite peripheral wall members of the second frame component. The tie-down panels perform the dual function of holding clothes securely in place in the main compartment, both in the expanded state and the retracted state thereof, and of providing convenient additional storage space.

For still greater versatility of the luggage item, a low-profile clothes hanger bracket adapted to hold both wire hangers and wooden (suit) hangers may be mounted on the rear side of the front panel. This feature allows clothes to be packed directly from the closet.

DESCRIPTION OF THE DRAWINGS

For a more complete understanding of the present invention, and the advantages thereof, reference may be made to the following written description of an exemplary embodiment, taken in conjunction with the accompanying drawings, in which.

DESCRIPTION OF AN EXEMPLARY EMBODIMENT

Figure 1:
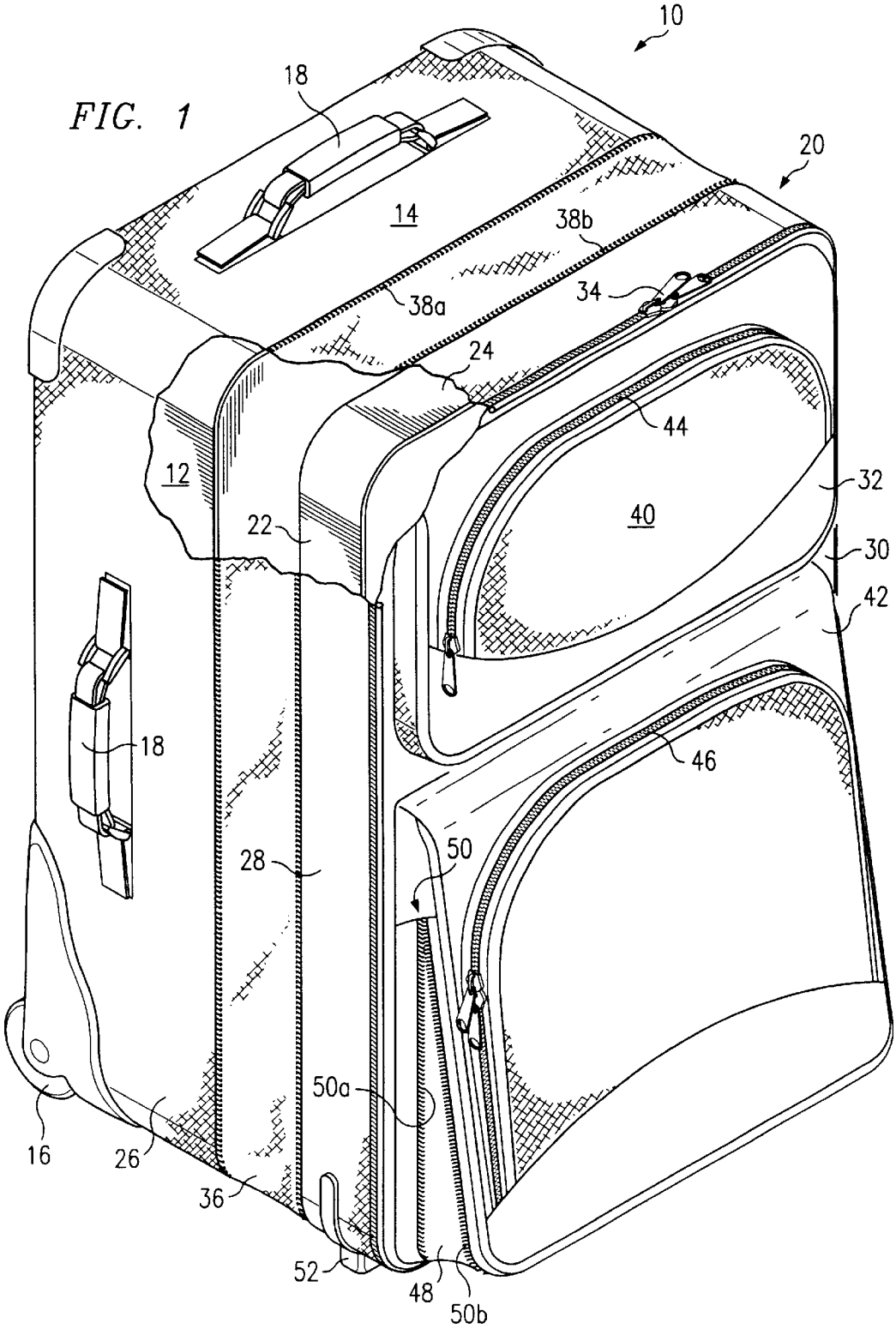
FIG. 1 is a generally schematic three-quarter front pictorial view of the embodiment, with portions broken away.

The embodiment shown in FIG. 1 has a two-component frame, which may be of any suitable specific construction in terms of materials, manner of assembly, and configurations of the parts. A main frame component 10 has a pair of opposite rectangular planar side wall panels 12 (only one of which is shown) and a pair of opposite wall members 14 (only one of which is shown), which are substantially rigid and rigidly connected at the corners. The opposite wall members are also referred to herein as top and bottom members, which is their normal orientation when the luggage item is in use. Although the drawing shows the member 14 as a panel, most travel luggage being marketed currently is of the towable, wheeled type. In practice for such luggage items, the bottom member and top member of the main frame are configured to accept wheels 16, a towing handle (not shown), one or more carrying handles 18, and the like. The main frame component 10 may also have a partial or complete rigid back wall panel. A secondary frame component 20 is formed of opposite rectangular planar panels 22 and top and bottom members 24, which as a practical matter will usually also be rectangular planar panels of sheet material.

The main frame component 10 receives a cover 26 of a durable fabric. The sides, top and bottom of the secondary frame receive a fabric cover 28. Access to the interior of the luggage item is through a front opening that is closed by a panel 30, is joined to the cover 28 at the side edge 32 and can be opened and closed by undoing and doing up a zipper 34 along three sides.

The main part (main frame 10 and its cover 26) of the luggage item is joined to the secondary part (secondary frame 20 and its cover 28, 30) by a gusset 36 of a durable, flexible material that extends around the entire perimeter of the luggage item (along the top, bottom and both side walls). In the expanded state of the item, the gusset 36 peripherally bounds that part of the entire volume of the main compartment by which the volume of the item is increased upon movement of the secondary unit away from the main unit. In the retracted (smaller volume) state (not shown) of the luggage item, a zipper having mating halves 38*a*, 38*b* on the adjacent ends of the main frame component 10 and the secondary frame 20, and which extends about the entire perimeter of the item, is done up. The gusset 36 folds into the interior of the item in the retracted state of the item.

As disclosed in U.S. Pat. No. 6,220,411 B1, the main frame component 10 may be joined to the secondary frame component 20 by two identical bridge assemblies (not shown), one of which is associated with the side panels 12 and 22 and the other with the opposite side members (not shown). The bridge assemblies stabilize the shape of the luggage item by preventing up and down movements, side to side movements, rotational skewing movements, and side to side and front to back cocking movements of the secondary unit relative to the main unit. Such bridge assemblies may be incorporated into the embodiment of FIG. 1 if desired. Alternatively, they may be omitted, particularly in luggage items in which the enhanced stability provided by the bridge assemblies is not required.

As shown in FIG. 1, one or more external pockets 40, 42 are provided on the front side of the front panel 30. Zippers 44, 46 may be provided for opening and closing the pockets.

In accordance with the invention, the lower pocket 42 includes in its bottom and side walls a second gusset 48 of flexible material, suitably of the same type as used for the first gusset 36. The edges of the pocket 42 adjoining the gusset 48 carry the mating halves 50*a*, 50*b* of a zipper 50 that extends peripherally over the full length of the gusset 48. As will be appreciated, the front pocket 42 is in a retracted state when the zipper 50 is done up, and in an expanded state when the zipper 50 is undone. Thus, a second stage of expandability is provided in the luggage item, which affords still greater flexibility in adapting the items to the requirements of different itineraries.

Although shown in FIG. 1 as extending only on three sides of the front pocket 42, the gusset 48 could extend continuously around the entire periphery of the front pocket, like the first gusset 36. Also, if desired, an expansion gusset could be incorporated into the front pocket 40, to provide still more added storage space.

For enhanced stability of the luggage item, particularly in the expanded state, the front legs 52 of the item are mounted on the lower wall of the second frame component 20. Thus, when the main compartment is extended, the front legs 52 move forward with the second frame component.

Figure 2:
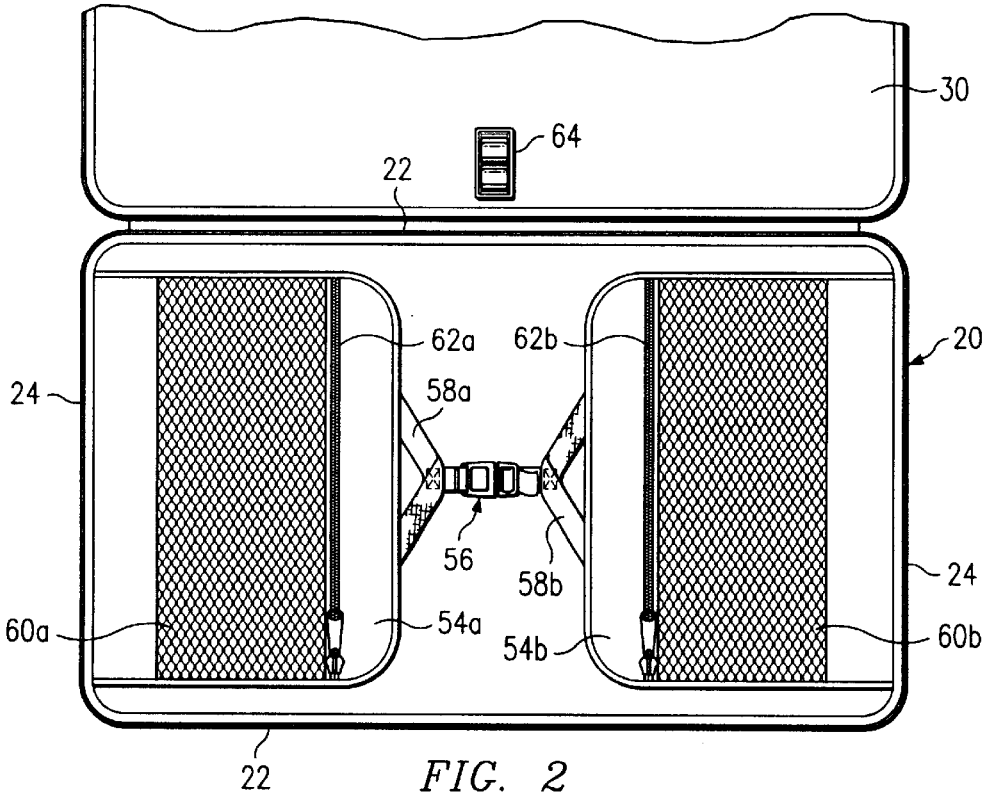
FIG. 2 is a front view of the embodiment, with the front panel opened and folded back.

FIG. 2 depicts a simplified front view of the luggage item with the front panel 30 folded open. A pair of tie-down panels 54*a*, 54*b* are attached to respective ones of the opposite wall members 24 of the second frame component 20. The tie-down panels 54*a*, 54*b* serve the dual function of better holding clothes in place (than do the narrow tie-down straps conventionally used) and of also providing convenient storage for last-minute items, or the like.

The panels 54*a*, 54*b*, therefore, extend over at least half, and preferably nearly all, of the distance between the opposite wall panels 22 of the second frame component and at least one-quarter, and preferably at least one-third, of the distance between the opposite wall members 24. The panels 54*a*, 54*b* are releasably attached to one another by a quick-release buckle 56 (or other conventional connecting tie or mechanism), whose mating halves are connected to the individual panels in any suitable way, e.g., by straps 58*a*, 58*b* that are attached to the facing ends of the panels at spaced points along their width. The relatively broad extent of the tie-down panels 54*a*, 54*b* ensures that clothing will be securely held in place during transit.

Also, at least one, and preferably both, of the panels 54*a*, 54*b* incorporates a pocket 60*a*, 60*b* for convenient additional storage. Zippers 62*a*, 62*b*, may be provided for greater security. For convenience, the upper or front side(s) of the pocket or pockets 62*a*, 62*b* is preferably formed of a see-through mesh for convenience of viewing the articles stored in the pocket(s).

The panels 54*a*, 54*b* are preferably connected to the second frame component 20, so that, when the luggage item is expanded, the panels move along with the frame 20 to overlie the expanded volume of the main compartment.

As noted above, the tie-down panels 54*a*, 54*b* may, if desired, be provided in a non-expandable luggage item. In that case, the panels 54*a*, 54*b* could be connected to stationary frame members of the item, corresponding, for example, to the opposite wall members 24 of FIG. 1.

The above-described dual-function tie-down panel feature is the subject of applicant's copending U.S. patent application Ser. No. 10/115,385 filed concurrently herewith and entitled "Luggage With Tie-Down Pockets".

Figure 3:
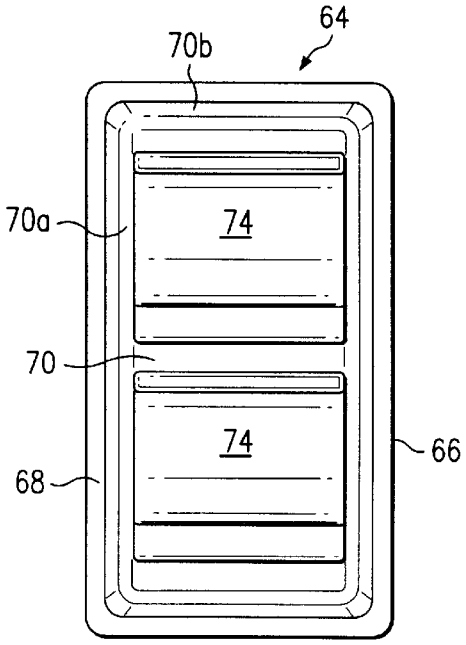
FIG. 3 is a plan view of the clothes hanger bracket of the embodiment.

As shown in FIG. 2, a clothes hanger bracket 64 is mounted on the rear side of the front panel 30 near the side thereof connected to the second frame component wall panel 22. The structure of the bracket 64 is shown in more detail in FIGS. 3 and 4.

The bracket 64, which is preferably formed as a single-piece plastic component, includes a rectangular base member 66 having a peripheral border region 68 and a raised central region 70. The edges 70*a*, 70*b* of the central region are preferably beveled. The bracket 64 may be secured to the front panel 30 in any suitable manner, e.g., by stitching through the peripheral region 68.

Figure 4:
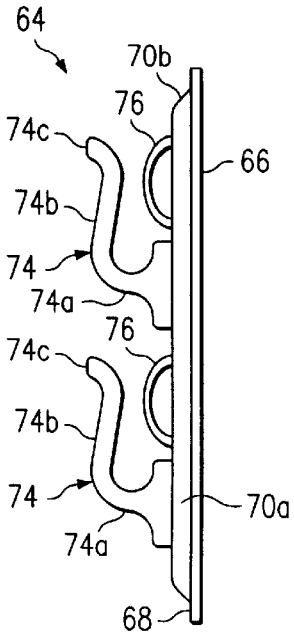
FIG. 4 is side view of the clothes hanger bracket of FIG. 3.

At least one, and preferably two, clothes hanger hooks 74 are carried by the central region 70 of the base member 66. As best shown in FIG. 4, each hook 74 includes a first portion 74*a* that extends generally perpendicular to the base member 66, then curves into a second portion 74*b* that extends along the base member in spaced relation thereto, and then curves away from the base member to terminate in a free end 74*c*.

The spacing between the second portion 74*b* and the base member is preferably only slightly greater than the thickness of the hook of a single clothes hanger. This gives the bracket 64 an advantageous, space-saving low profile in cross section. A resilient detent member 76 is provided on the base member in opposed relation to the second hook portion 74*b*. The detent 76 and the opposed hook portion 74*b* are adapted together to capture a clothes hanger hook therebetween. To that end, the second portion 74*b* may be inclined slightly towards the base member 66.

The length of the hook portion 74*b* along the base member is preferably sufficient to accommodate two or more clothes hangars stacked on one another in the lengthwise direction of the second portion 74*b*. The free end 74*c* of each hook 74 curves away from the base member to facilitate entry of the hook end of a clothes hanger into the space between the second hook portion 74*b* and the base member 66. The bracket is useful with either wire or wooden hangers, thereby allowing clothing, e.g. dresses or suits, to be packed directly from the closet.

In the luggage item shown in FIGS. 1 and 2, the bracket 64 is advantageously located as shown in FIG. 2, where it would be adjacent a fold-out suiter section (not shown). The bracket may alternatively be located in other positions within a luggage item, depending upon the size and configuration of the item. As already noted, the bracket 64 has utility in luggage items independently of the expandability and tie-down panel features described above.

The above-described low-profile clothes hanger bracket is the subject of applicant's copendingly U.S. application Ser. No. 10/115,386 filed concurrently and entitled "Luggage With Low-Profile Hanger Bracket".

Although the invention has been described and illustrated herein by reference to specific embodiments thereof, it will be understood that such embodiments are susceptible of modification and variation without departing from the inventive concepts disclosed. All such modifications and variations, therefore, are intended to be encompassed within the spirit and the appended claims.

What is claimed is:

1. An item of expandable luggage, comprising:

a frame having a first, substantially rigid, rear component and a second, substantially rigid, front component, each of which components includes a pair of opposite peripheral wall panels that together with another pair of opposite peripheral wall members form the peripheral boundary of a variable main compartment enclosure and a generally rectangular area;

a peripherally continuous first gusset of flexible material coupled between the peripheral wall panels and the peripheral wall members of the two frame components in the front to rear direction, the adjacent ends of the first and second frame components carrying mating halves of a peripherally continuous, first zipper, which, when undone, permits the first gusset to unfold in the forward direction to enlarge the main compartment enclosure;

a front panel of flexible material covering the end of the second frame component;

a second zipper extending around at least three sides of the second frame component and the front panel for releasably coupling the front panel to the second frame component, to permit access to the main compartment of the luggage item;

at least one external front pocket carried by the flexible front panel, said at least one front pocket comprising along the bottom and substantially the full length of both sides thereof a second gusset of flexible material, the top of the front pocket being non-expandably attached to the front panel; and the edges of the front pocket adjoining the second gusset carrying mating halves of a third zipper which, when undone, permits the second gusset to unfold in the forward direction to enlarge the volume enclosed by the at least one front pocket.

2. The item of luggage as claimed in claim 1, further comprising one or more legs mounted on the exterior of one of the opposite peripheral wall members of the second frame component for supporting the second frame component on a supporting surface.

3. The item of luggage as claimed in claim 1, further comprising:

a pair of internal tie-down panels respectively coupled at one end thereof to the interior sides of the pair of opposite peripheral wall members of the second frame component;

each of the internal tie-down panels extending over at least one-half of the distance between the pair of opposite peripheral wall panels of the second frame component and over at least one-quarter of the distance between the pair of opposite peripheral wall members of the second frame component; and cooperating tie-down elements carried by the respective tie-down panels at the ends thereof remote from the opposite peripheral wall members of the second frame component for releasably connecting the pair of tie-down panels to one another.

4. The item of luggage as claimed in claim 3, wherein at least one of the tie-down panels comprises a pocket for storing articles.

5. The item of luggage as claimed in claim 4, wherein at least the front surface of the pocket of the at least one tie-down panel comprises a see-through mesh material permitting viewing of articles stored in the pocket.

6. The item of luggage as claimed in claim 5, wherein the pocket of the at least one tie-down panel further comprises a zipper for selectively opening and closing the pocket.

7. The item of luggage as claimed in claim 6, wherein each of the tie-down panels extends nearly the entire distance between the opposite peripheral wall panels of the second frame component.

8. The item of luggage as claimed in claim 7, wherein each of the tie-down panels includes one of said pockets.

9. The item of luggage as claimed in claim 1, further comprising a clothes hanger bracket mounted on the rear side of the front panel, said clothes hanger bracket comprising:

a base member secured to the front panel; and at least one hook member extending in a first portion generally perpendicularly to the base member, then curving to extend in a second portion along, but spaced from, the base member, and terminating in a free end spaced from the base member.

10. The item of luggage as claimed in claim 9, wherein the base member is secured to the front panel by stitching around the periphery of the base member.

11. The item of luggage as claimed in claim 9, wherein the length of the first portion of each hook member is such that the spacing between the second hook member portion and the base member is only slightly greater than the thickness of the hook end of a single clothes hanger, whereby the clothes hanger bracket has a low profile as viewed in cross section.

12. The item of luggage as claimed in claim 11, wherein the clothes hanger bracket further comprises a resilient detent member carried by the base member opposite the second portion of the at least one hook member, whereby the resilient detent member and the hook member second portion are operative to capture the hook end of a clothes hanger therebetween.

13. The item of luggage as claimed in claim 12, wherein the clothes hanger bracket is a one-piece plastic component.

14. The item of luggage as claimed in claim 13, wherein the clothes hanger bracket comprises an identical pair of said hook members.

15. The item of luggage as claimed in claim 13, wherein the length of the second portion of the at least one hook member is sufficient to receive two or more coat hanger hook ends, stacked one on another in the lengthwise direction of the second portion, in the space between the second hook member portion and the base member.

16. The item of luggage as claimed in claim 10, wherein the second hook member portion is slightly inclined from the first hook member portion towards the base member and is curved at its free end away from the base member to facilitate entry of the hook end of a clothes hanger into the space between the second hook member portion and the base member.

17. An item of expandable luggage, comprising:

a frame having a first, substantially rigid, rear component and a second, substantially rigid, front component, each of which components includes a pair of opposite peripheral wall panels that together with another pair of opposite peripheral wall members form the peripheral boundary of a variable main compartment enclosure and a generally rectangular area;

a peripherally continuous first gusset of flexible material coupled between the peripheral wall panels and the peripheral wall members of the two frame components in the front to rear direction, the adjacent ends of the first and second frame components carrying mating halves of a peripherally continuous, first zipper, which, when undone, permits the first gusset to unfold in the forward direction to enlarge the main compartment enclosure;

a front panel of flexible material covering the end of the second frame component;

a second zipper extending around at least three sides of the second frame component and the front panel for releasably coupling the front panel to the second frame component, to permit access to the main compartment of the luggage item;

at least one external front pocket carried by the flexible front panel, said at least one front pocket comprising along the bottom and substantially the full length of both sides thereof a second gusset of flexible material, the top of the front pocket being non-expandably attached to the front panel;

the edges of the front pocket adjoining the second gusset carrying mating halves of a third zipper which, when undone, permits the second gusset to unfold in the forward direction to enlarge the volume enclosed by the at least one front pocket;

a pair of internal tie-down panels respectively coupled at one end thereof to the interior sides of the pair of opposite peripheral wall members of the second frame component;

each of the internal tie-down panels extending over at least one-half of the distance between the pair of opposite peripheral wall panels of the second frame component and over at least one-quarter of the distance between the pair of opposite peripheral wall members of the second frame component;

cooperating tie-down elements carried by the respective tie-down panels at the ends thereof remote from the opposite peripheral wall members of the second frame component for releasably connecting the pair of tie-down panels to one another; and a clothes hanger bracket mounted on the rear side of the front panel, said clothes hanger bracket including:

a base member secured to the front panel; and at least one hook member extending in a first portion generally perpendicularly to the base member, then curving to extend in a second portion along, but spaced from the base member, and terminating in a free end spaced form the base member.

18. The item of luggage as claimed in claim 17, wherein the base member is secured to the front panel by stitching around the periphery of the base member.

19. The item of luggage as claimed in claim 17, wherein at least one of the tie-down panels comprises a pocket for storing articles.

20. The item of luggage as claimed in claim 19, wherein at least the front surface of the pocket of the at least one tie-down panel comprises a see-through mesh material permitting viewing of articles stored in the pocket.

21. The item of luggage as claimed in claim 20, wherein the pocket of the at least one tie-down panel further comprises a zipper for selectively opening and closing the pocket.

22. The item of luggage as claimed in claim 21, wherein each of the tie-down panels extends nearly the entire distance between the opposite peripheral wall panels of the second frame component.

23. The item of luggage as claimed in claim 22, wherein each of the tie-down panels includes one of said pockets.

24. The item of luggage as claimed in claim 17, wherein the length of the first portion of each hook member is such that the spacing between the second hook member portion and the base member is only slightly greater than the thickness of the hook end of a single clothes hanger, whereby the clothes hanger bracket has a low profile as viewed in cross section.

25. The item of luggage as claimed in claim 24, wherein the clothes hanger bracket further comprises a resilient detent member carried by the base member opposite the second portion of the at least one hook member, whereby the resilient detent member and the hook member second portion are operative to capture the hook end of a clothes hanger therebetween.

26. The item of luggage as claimed in claim 25, wherein the clothes hanger bracket is a one-piece plastic component.

27. The item of luggage as claimed in claim 26, wherein the clothes hanger bracket comprises an identical pair of said hook members.

28. The item of luggage as claimed in claim 26, wherein the length of the second portion of the at least one hook member is sufficient to receive two or more coat hanger hook ends, stacked one on another in the lengthwise direction of the second portion, in the space between the second hook member portion and the base member.

29. The item of luggage as claimed in claim 17, wherein the second hook member portion is slightly inclined from the first hook member portion towards the base member and is curved at its free end away from the base member to facilitate entry of the hook end of a clothes hanger into the space between the second hook member portion and the base member.

* * * * *

UNITED STATES PATENT AND TRADEMARK OFFICE

CERTIFICATE OF CORRECTION

PATENT NO. : 6,591,950 B1
DATED : July 15, 2003
INVENTOR(S) : Scicluna, Paul

It is certified that error appears in the above-identified patent and that said Letters Patent is hereby corrected as shown below:

Column 4,
Line 64, “hangars” should read -- hangers --

Column 5,
Line 14, “copendingly” should read -- copending --
Line 38, “continuous,” should read -- continuous --

Column 7,
Line 23, “continuous,” should read -- continuous --

Column 8,
Line 8, “form” should read -- from --

Signed and Sealed this

Eighteenth Day of November, 2003

JAMES E. ROGAN
*Director of the United States Patent and Trademark Office*